US005417590A

United States Patent [19]

Dechelette et al.

[11] Patent Number: 5,417,590

[45] Date of Patent: May 23, 1995

[54] PLUG AND SOCKET ELECTRICAL CONNECTOR SYSTEM

[75] Inventors: Helen Dechelette, Wissous; Jerome Tamsson, Paris, both of France

[73] Assignee: Molex Incorporated, Lisle, Ill.

[21] Appl. No.: 148,487

[22] Filed: Nov. 8, 1993

[30] Foreign Application Priority Data

Dec. 2, 1992 [EP] European Pat. Off. ..... 92120544

[51] Int. Cl.[6] ..... H01R 13/648

[52] U.S. Cl. ..... 439/607; 439/680

[58] Field of Search ..... 439/677, 680, 681, 607, 439/608, 609, 610, 98, 101, 108

[56] References Cited

U.S. PATENT DOCUMENTS

| | | | |
|---|---|---|---|
| 4,337,989 | 7/1982 | Asick et al. . | |
| 4,350,409 | 9/1982 | Kato et al. | 439/681 |
| 4,449,767 | 5/1984 | Weidler | 439/681 X |
| 4,571,012 | 2/1986 | Bassler et al. . | |
| 4,596,436 | 6/1986 | Kraemer et al. | 439/701 |
| 4,623,211 | 11/1986 | Dambach et al. . | |
| 4,653,836 | 3/1987 | Peele . | |
| 4,687,263 | 8/1987 | Cosmos et al. | 439/108 |
| 4,718,867 | 1/1988 | Seidel et al. | 439/609 |
| 4,781,623 | 11/1988 | Philippson et al. | 439/610 |
| 4,932,888 | 6/1990 | Senor | 439/108 |
| 5,158,474 | 10/1992 | Frantz | 439/680 X |
| 5,254,018 | 10/1993 | Sawda | 439/680 |
| 5,304,067 | 4/1994 | Inaba et al. | 439/610 X |

*Primary Examiner*—Khiem Nguyen
*Attorney, Agent, or Firm*—Stacey E. Caldwell

[57] ABSTRACT

A shielded plug and socket electrical connector system is provided for interconnecting a plurality of shielded electrical cables with a printed circuit board. A plurality of plug connectors each include a dielectric housing which mounts a plurality of terminals terminated to conductors of a shielded cable and a two-part shielding hood configured for substantially enclosing the housing. Each plug connector includes a grounding contact fitted within one part of the shielding hood. The grounding contact includes a first plug portion adapted for conductively engaging a shield of the cable and a second plug portion exposed exteriorly of the hood. A socket connector is adapted for mounting to the printed circuit board and includes an elongated dielectric housing defining a plurality of receptacles each for receiving a corresponding one of the plurality of plug connectors. The socket connector includes a grounding bar mounted on the housing and extending lengthwise thereof. The grounding bar includes a first socket portion adapted for connection to a grounding trace on the printed circuit board. The grounding bar also includes a plurality of second socket portions each located adjacent a receptacle and adapted to engage the second plug portion of the grounding contact of each of the corresponding plurality of plug connectors when received in the receptacles.

11 Claims, 9 Drawing Sheets

PLUG AND SOCKET ELECTRICAL CONNECTOR SYSTEM

FIELD OF THE INVENTION

This invention generally relates to the art of electrical connectors and, particularly, to a plug and socket electrical connector system for interconnecting a plurality of shielded or unshielded electrical cables with a printed circuit board.

BACKGROUND OF THE INVENTION

Plug and receptacle connector systems often are used to interconnect printed circuit boards to multi-conductor cables. Heretofore, grounding the shield of a cable has been accomplished by using a drain wire to connect the cable shield, through a connector, to a ground trace of the printed circuit board. Problems are encountered with grounding drain wires because they are difficult to manipulate, and often become damaged or deformed.

Some plug and receptacle connector systems are of a type having a single elongated connector provided with a plurality of receptacles for receiving a plurality of plugs. Keying, i.e. coding similarly configured connectors such that the correct connector is mated into a correct receptacle, heretofore has been achieved by retrofitting a plastic shroud to a standard elongated header, the shroud having keyways that accept unprotected keys integrally molded on the plug connectors. Retrofitting requires an additional component, and the unprotected keys often are broken to confuse the keying system.

Polarizing, i.e. assuring that a particular plug connector is properly oriented with respect to its corresponding receptacle of the multi-receptacle connector, often is not provided at all in such connector systems.

This invention is directed to providing an plug and socket electrical connector system wherein a plurality of plug connectors are receivable in a plurality of receptacles of a socket connector, wherein effective electromagnetic shielding and grounding may be provided, along with a reliable keying system and polarizing system, all of which is significant in view of the increased use of shielded cables in high speed applications.

SUMMARY OF THE INVENTION

An object, therefore, of the invention is to provide a new and improved plug and socket electrical connector system of the character described and which is particularly adaptable for interconnecting a plurality of shielded electrical cables with a printed circuit board.

In the exemplary embodiment of the invention, a plurality of plug connectors are provided, each plug connector including a dielectric housing adapted for mounting a plurality of contacts terminated to conductors of a shielded cable. A two-part hood is configured for substantially enclosing the housing. In shielding applications, the hood provides shielding, and a stamped and formed metal grounding contact is fitted within one part of the two-part shielding hood and includes a first plug portion adapted for conductively engaging a shield of the cable and a second plug portion exposed exteriorly of the hood.

A socket connector is provided for mounting to the printed circuit board. The socket connector includes an elongated dielectric housing defining a plurality of receptacles each for receiving a corresponding one of the plurality of plug connectors. In shielding applications, a stamped and formed metal grounding bar is mounted on the housing extending lengthwise thereof and includes at least one first socket portion adapted for conductive connection to a grounding circuit trace on the printed circuit board and a plurality of second socket portions each located adjacent a receptacle and adapted to engage the second plug portion of the grounding contact of each of the corresponding plurality of plug connectors when received within the receptacle.

Complementary interengaging means are provided between the grounding contact of each plug connector and a second part of the two-part shielding hood for interconnecting the two parts of the hood about the dielectric housing. The complementary interengaging means include at least one interengaging arm of the grounding contact projecting from the one part of the two-part shielding hood into locking engagement with the second part of the two-part hood. The interengaging arm includes locking means for locking the grounding contact within the one part of the two-part shielding hood.

The receptacles of the dielectric housing of the socket connector are defined at least in part by a mating edge of the housing. The plurality of second socket portions of the grounding bar are provided by cantilevered beams spaced along the grounding bar and reversely bent into the receptacles for engaging the second plug portion of the grounding contact of the plurality of plug connectors.

Generally, polarization means are provided between the socket connector and each plug connector to ensure proper orientation of the plug connectors in the receptacles. Specifically, one of each plug connector and socket connector includes a pair of latch arms and the other of each socket connector and plug connector includes a complementary pair of latch arm grooves. The polarization means is provided by forming one of each pair of latch arms and its respective latch arm keeper of a different size than the other of each pair of latch arms and its respective latch arm keeper.

Generally, keying means are provided between the socket connector, at each receptacle thereof, and each plug connector, whereby each plug connector can be received by only a given one of the receptacles. Specifically, the keying means include at least one keyway in the housing of the socket connector at each receptacle thereof and at a location different from that of the other receptacles. A plurality of frangible keys are provided on each plug connector at locations corresponding to all of the different locations of keyways at the receptacles in the socket connector housing. The keys can be broken away to leave at least one key for each plug connector at a location corresponding to the location of a keyway at a desired receptacle in which the respective plug connector is desired to be inserted.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
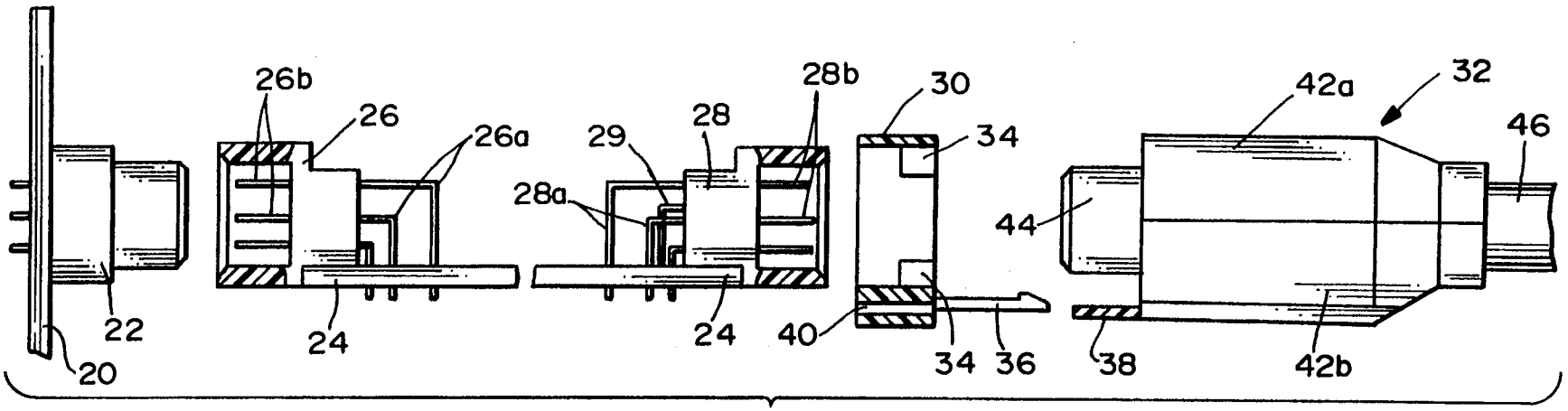
FIG. 1 (PRIOR ART)
FIG. 1 is an exploded side elevational view, partially in section, of a printed circuit board plug and socket electrical connector system of the prior art.

Referring to the drawings in greater detail, and first to FIG. 1, a shielded plug and socket electrical connector system of the prior art is illustrated. The system is designed for printed circuit board applications. Specifically, a first printed circuit board 20, commonly called a mother board, has a printed circuit board connector 22 mounted thereon, with solder tails 22*a* of appropriate terminals of the connector soldered to appropriate circuit traces of the mother board. A second printed circuit board 24, commonly called a daughter board, is interconnected with mother board 20 by means of a second printed circuit board connector 26 having solder tails 26*a* of a plurality of terminals 26*b* soldered to appropriate circuit traces on the printed circuit board. Connector 22 is shown as a plug connector and connector 26 is shown as a socket connector. In common terminology, the connectors allow daughter board 24 to be "plugged in" to mother board 20. Another socket connector 28, similar to socket connector 26, is mounted at a remote location on daughter board 24 and is shown similarly constructed to socket connector 26. Solder tails 28*a* of terminals 28*b* are soldered to appropriate circuit traces on the daughter board.

Heretofore, in the prior art schemes illustrated in FIG. 1, the second socket connector 28 has been retrofitted with a plastic shroud 30. It should be understood that socket connector 28 is elongated (perpendicular to the plane of the figure) for receiving a plurality of plug connectors, generally designated 32. Therefore, shroud 30 includes a plurality of separator portions 34 for separating the shroud, and thereby connector 28, into discrete receptacles. Retrofitted shroud 30 includes a latch arm 36 for engaging appropriate latch arm keeper means on plug connector 32. The plug connector includes an unprotected key 38 for insertion into a keyway 40 of retrofitted shroud 30. These unprotected keys are fragile and easily broken.

Lastly, the shielded plug and socket electrical connector system of the prior art shown in FIG. 1 provides each plug connector 32 with a two-part shielding hood including shield halves 42*a* and 42*b*. The shield halves surround a plug connector housing 44 which is terminated to a shielded electrical cable 46. In order to ground the shield of electrical cable 46 to a ground circuit trace of daughter board 24, conventionally, a drain wire (not shown) has been connected to the cable shield, extending through the plug connector and through retrofitted shroud 30 for interconnection with a ground terminal 29 of socket connector 28 and, in turn, to the ground circuit trace on daughter board 24.

Figure 2:
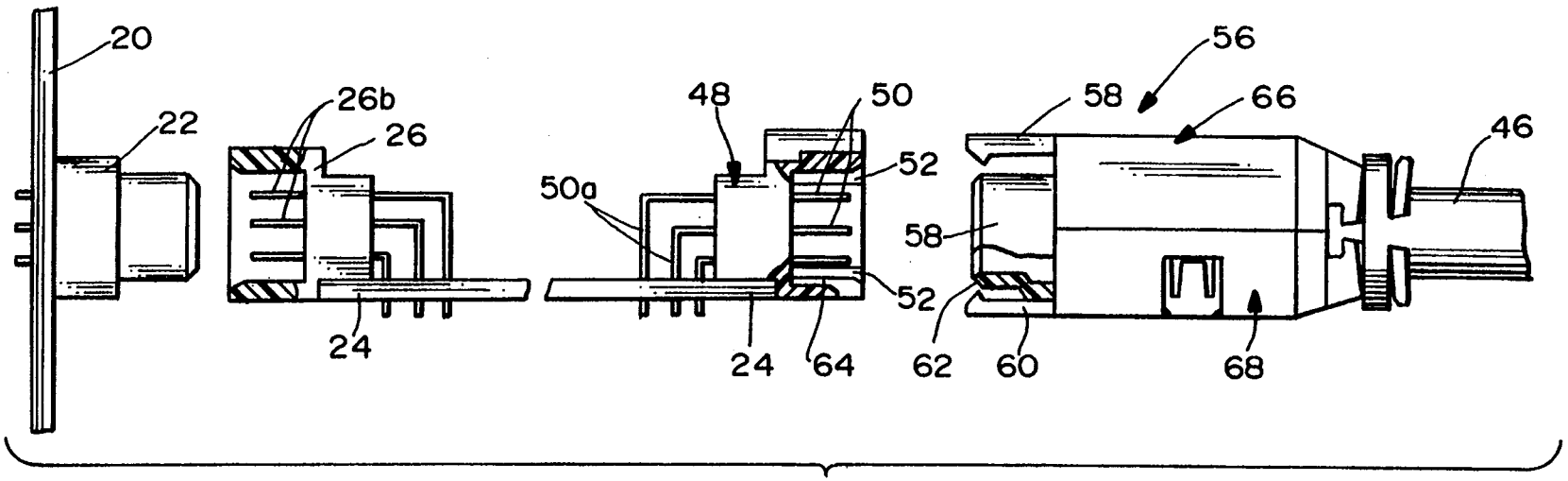
FIG. 2 is an exploded side elevational view, partially in section, of a plug and socket electrical connector system incorporating the concepts of the invention.

FIG. 2 generally shows the plug and socket electrical connector system of the invention. Like numerals have been applied to mother board 20, printed circuit board plug connector 22, socket connector 26 and its respective terminals, along with daughter board 24. These components do not form part of the invention but illustrate an appropriate application of the invention as a distinct improvement over the system shown in FIG. 1.

Generally, a multi-receptacle socket connector, generally designated 48, includes terminals 50 having solder tails 50*a* interconnected to circuit traces on daughter board 24. As will be described in greater detail hereinafter, the socket connector includes a dielectric housing which is elongated and includes integral separators 52 for dividing the housing into discrete receptacles for receiving a plug portion 54 of a housing of one of a plurality of plug connectors, generally designated 56. Each plug connector has polarizing latch arms 58 and 60 and keys 62, all of which will be described in greater detail hereinafter. Suffice it to say, the keys are insertable into keyways 64 in the housing of socket connector 48. Each plug connector also includes a two-part hood, including hood parts or halves, generally designated 66 and 68. As with plug connector 32 shown in FIG. 1, the plug connector 56 of the invention is terminated to a electrical cable 46. The plug and socket electrical connector system may be utilized either in a shielded application, in which a grounding element and conductive hood is included, or an unshielded application, i.e. where no shielding or shielded cable is used.

Figure 6:
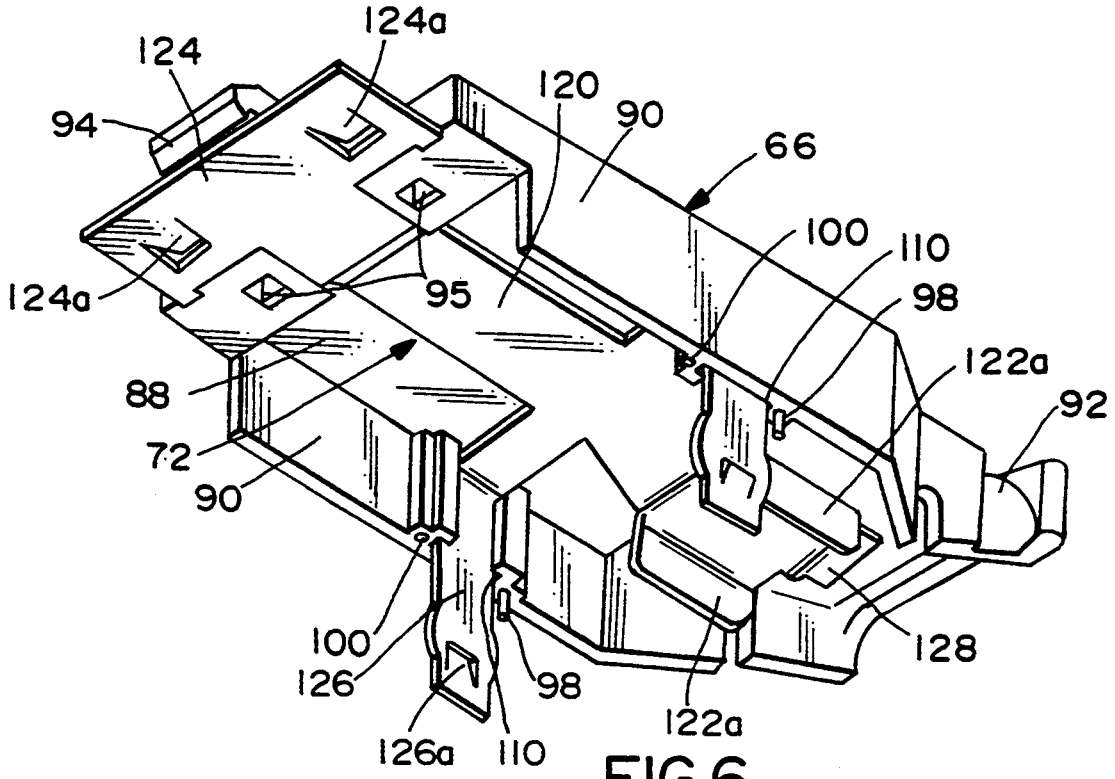
FIG. 6 is a perspective view of the grounding contact mounted in one part of the two-part shielding hood of one of the shielded plug connectors.
Figure 7:
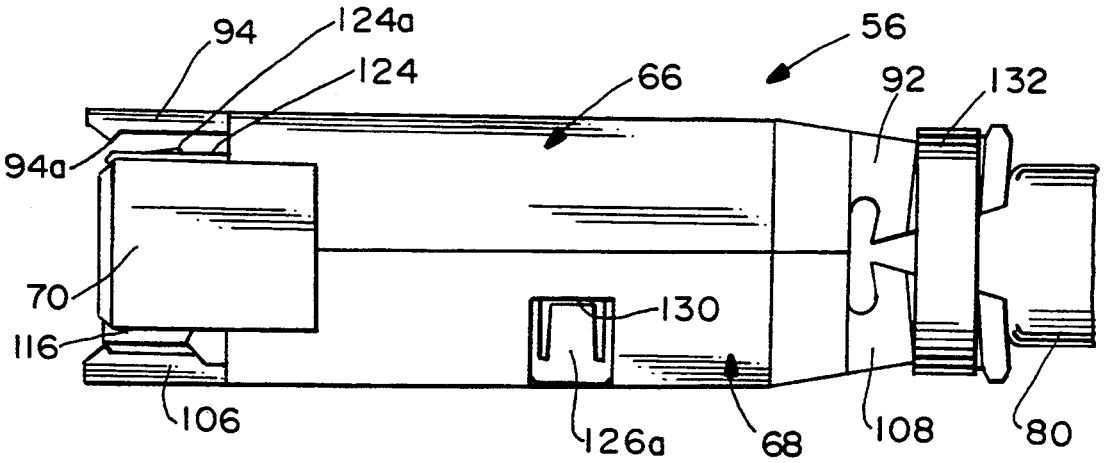
FIG. 7 is a side elevational view of one of the shielded plug connectors in assembled condition.
Figure 8:
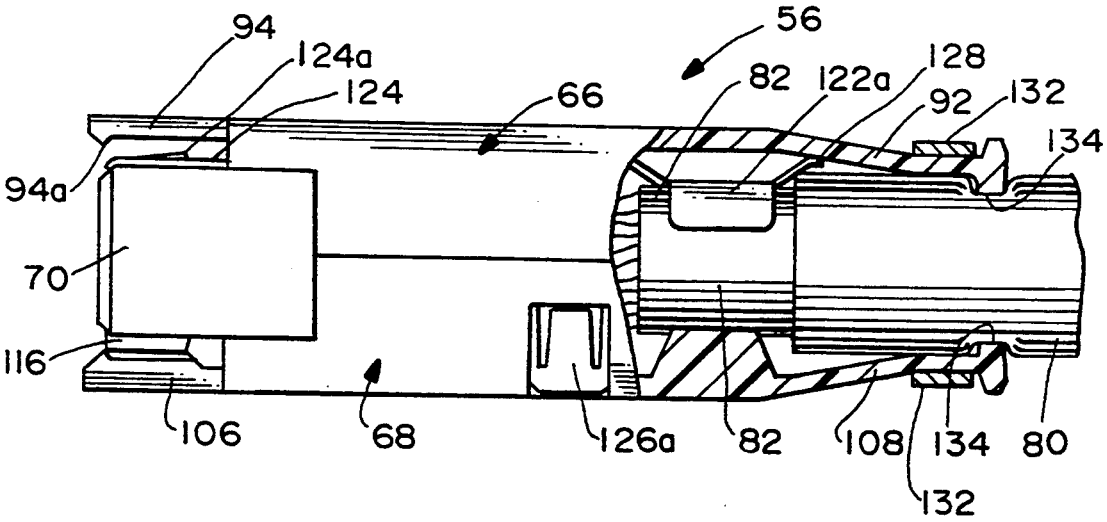
FIG. 8 is a side elevational view similar to that of the FIG. 7, partially broken away and in section.

FIGS. 3–8 show the details of plug connector 56 according to the invention. FIGS. 3–6 show the plug connector components in exploded depictions, and FIGS. 7 and 8 show the plug connector in assembled condition.

Figure 3:
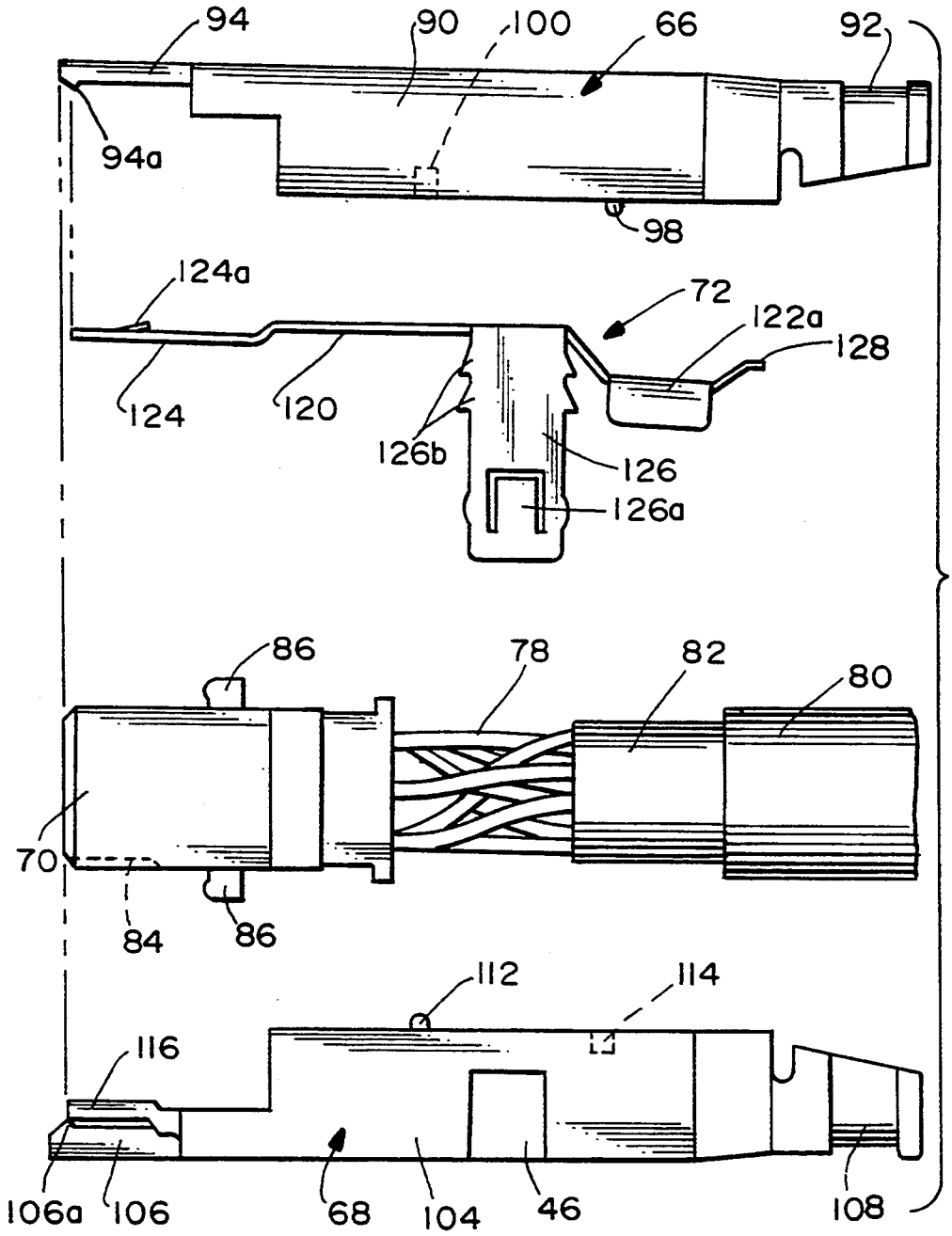
FIG. 3 is an exploded side elevational view of the components of one of the plug connectors, including a grounding contact along with a terminated shielded cable.

More particularly, referring first to FIG. 3, plug connector 56 includes a unitarily molded dielectric housing 70 (i.e. 54 in FIG. 2), a two-part hood, including hood parts 66 and 68 described above, and, in shielded applications, a stamped and formed metal grounding contact, generally designated 72. Typically, housing 70 is adapted for mounting a plurality of terminals terminated to conductors of a shielded cable, as described hereinafter. Two-part shielding hood 66,68 is configured for substantially surrounding or enclosing the housing. Grounding contact 72 is fitted within hood part 66 and conductively interengages with hood part 68, again as described in greater detail hereinafter.

Figure 4:
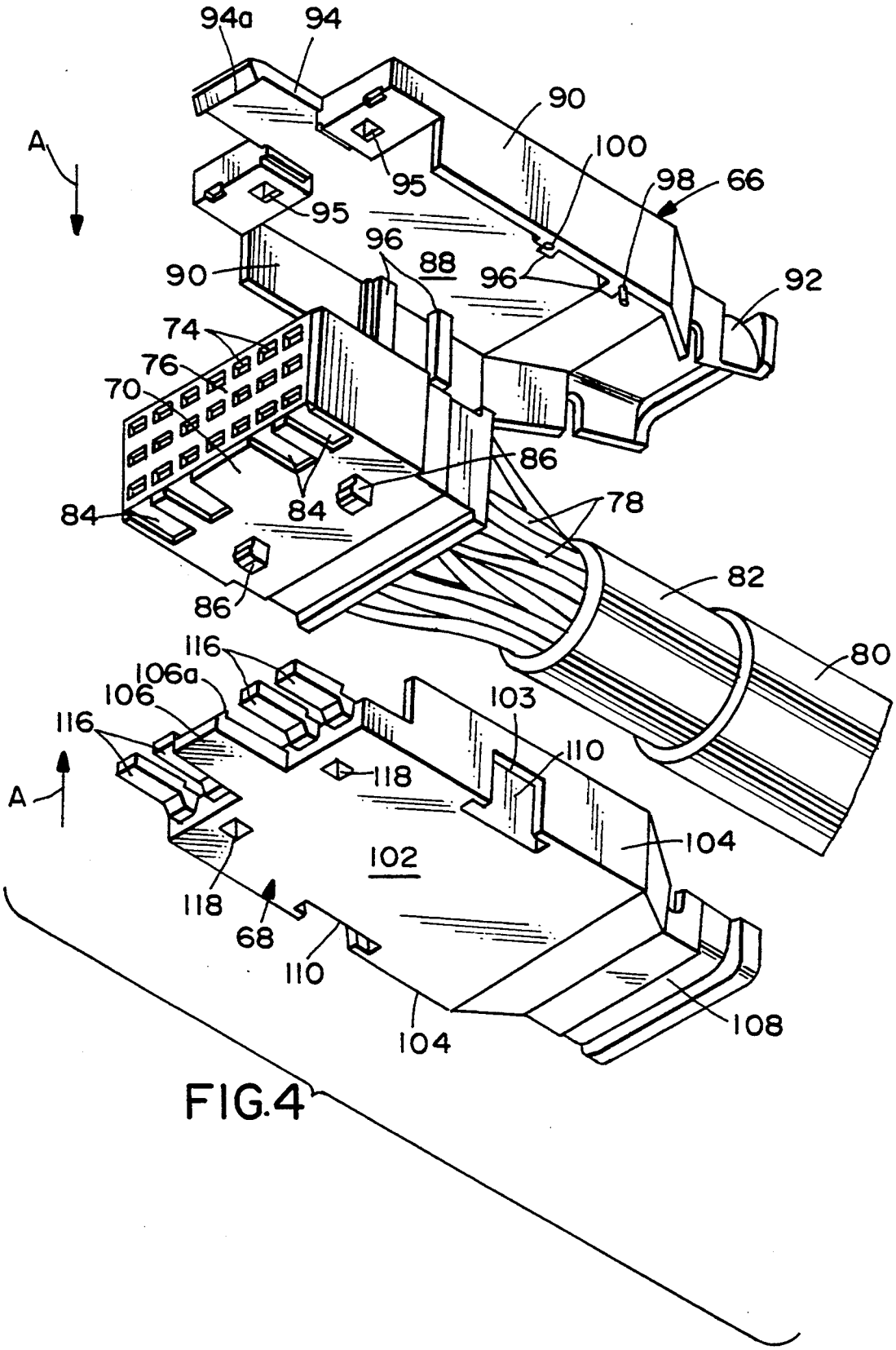
FIG. 4 is an exploded perspective view of the two-part hood and housing of one of the unshielded plug connectors, the grounding contact not being present.

Referring to FIG. 4 in conjunction with FIG. 3, housing 70 has a plurality of through cavities 74 open at a mating face 76 of the housing, the cavities mounting a plurality of terminals (not visible in the drawings) which are terminated to a plurality of discrete wires 78 of an electrical cable 80 which may include a shield 82, such as a foil, braid or the like, as is conventional with such multi-wire shielded cables. The housing further has four recesses 84 on a surface thereof for purposes described hereinafter, along with a pair of latch bosses 86 projecting from both the top and bottom of the housing for interengagement with hood parts 66,68.

Still referring to FIG. 4 in conjunction with FIG. 3, hood part 66 includes a planar base wall 88, a pair of side walls 90 projecting from the base wall, a rearwardly projecting collar portion 92 forming a continuation of the base wall, a forwardly projecting latch arm 94 (latch arm 58 in FIG. 1) having an inwardly directed hook portion **94*a*, a pair of latch holes 95, and two pairs of ribs 96 respectively on the inside of the two side walls 90. Each side wall 90 has one alignment pin 98 and one alignment hole 100** at the edge thereof, all for purposes described hereinafter.

The other hood part 68 is constructed generally similar to hood part 66 in that it has a generally planar base wall 102, a pair of side walls 104, a latch arm 106 (latch arm 60 in FIG. 1) projecting forwardly as a continuation of the base wall, the latch arm having a hook portion **106*a*, and a collar portion 108 projecting from the rear of base wall 102. Side walls 104 are provided with grooves 110 which are in alignment with ribs 96 of hood part 66 when the hood parts are assembled. Each edge of each side wall 104 is provided with one alignment pin 112 and one alignment hole 114. A plurality of keys 116 project forwardly from hood part 68. Base wall 102 is provided with a pair of latch holes 118**, all for purposes to be described below.

In shielded applications, both hood parts 66 and 68 are fabricated of shielding material, such as metal, or metallized or conductive plastic, or the like. In unshielded applications, i.e. when no shielding is required, the hood may be fabricated of unmetallized plastic. In assembly of the hood parts about dielectric housing 70, the hood parts are brought together in the direction of arrows "A" (FIG. 4), and each pair of latch bosses 86 on the top and bottom of the housing snap into the respective pairs of latch bosses 95 and 118 of hood parts 66 and 68, respectively. The hood parts are aligned by alignment pins 98 and 112 and alignment holes 100 and 114 at the edges of the side walls of the hood parts. This is best understood with reference to FIGS. 3 and 4 wherein it can be understood that alignment pin 98 of hood part 66 will enter alignment hole 114 of hood part 68, and alignment pin 112 of hood part 68 will enter alignment hole 100 of hood part 66. When in assembled condition, keys 116 will rest partially within recesses 84 of housing 70 and are protected thereby. Collar portions 92 and 108 of hood parts 66 and 68, respectively, will embrace cable 80.

Figure 5:
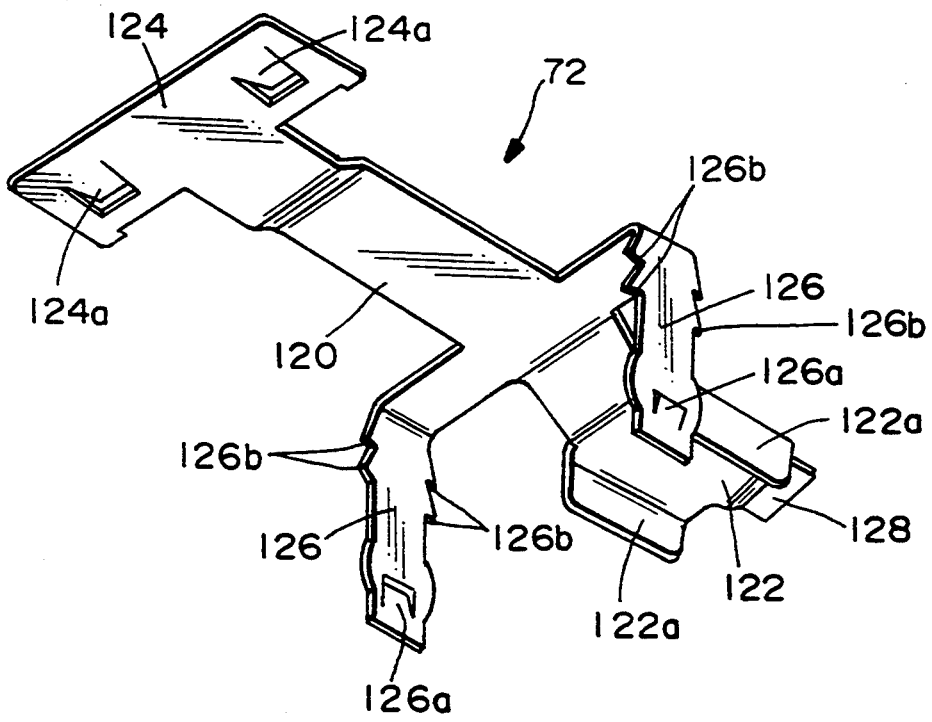
FIG. 5 is a perspective view of the grounding contact of each shielded plug connector.

Referring to FIGS. 5 and 6 in conjunction with FIGS. 3 and 4, it can be seen that, in shielded applications, grounding contact 72 is fitted or nested within hood part 66 as best depicted in FIG. 6. The grounding contact includes a body portion 120, a rear portion 122 offset from the body portion, a front portion 124 disposed forwardly of the body portion, and a pair of interengaging arms 126 projecting generally perpendicularly to the body portion. Rear portion 122 has a pair of side flanges **122*a* which define a receptacle means for receiving and engaging shield 82 of cable 80. A supporting lip 128 is offset outwardly from rear portion 122 for purposes to be described hereinafter. Front portion 124 is exposed exteriorly of hood part 66 as best seen in FIG. 6, and the front portion has a pair of spring tongues 124*a*, for purposes to be described hereinafter. Interengaging arms 126 also have spring tongues 126*a*, along with a plurality of teeth 126*b*** projecting outwardly from the side edges of the arms.

FIG. 6 shows how grounding contact 72 is fitted or nested within hood part 66. It can be seen that body portion 120 of the grounding contact rests against base wall 88 of the hood part. Supporting lip 128 rests against the inside of collar 92 to provide a support for the receptacle defined by the rear portion 122 and flanges **122*a* of the grounding contact which engage shield 82 of cable 80. It also should be noted how front portion 124 is exposed outside and forwardly of the hood part. Interengaging arms 126 are positioned within grooves 110 of the hood part, with the distal ends of the interengaging arms, including spring tongues 126*a*, projecting from the edges of side walls 90 of the hood part. Teeth 126*b* (FIG. 5) bite into the sides of grooves 110**.

When hood parts 66 and 68 are assembled about housing 70 in the direction of arrows "A" (FIG. 4) as described above, and additional reference can be made to FIGS. 7 and 8, interengaging arms 126 of grounding contact 72 perform two functions. First, with the grounding contact fabricated of stamped and formed sheet metal material, the arms are effective to conductively common the hood parts in their shielding function and to ground both hood parts to shield 82 of cable 80. Second, as best seen in FIGS. 7 and 8, spring tongues **126*a* snap behind ledges 130 of grooves 110 (FIG. 4) to hold the hood parts in assembled condition. FIG. 8 also shows how the rear portion 122, including flanges 122*a*, of the grounding contact engage shield 82 of cable 80, with supporting lip 128 engaging the inside of hood part 66. Lastly, FIG. 7 and 8 show a tie member 132 wrapped around collar portions 92 and 108 of hood parts 66 and 68, respectively, for clamping the collar portions about cable 80. It can be seen how the collar portions indent into the outer cladding of the cable, as at 134** (FIG. 8).

Socket connector 48 was described above in relation to FIG. 2, for mounting on daughter board 24 by means of terminals 50 having solder tails **52*a* inserted into appropriate holes in the daughter board for soldering to circuit traces on the board or in the holes. Now, it can be understood how terminals 50 are insertable into cavities 74 (FIG. 4) for termination to the plurality of terminals within housing 70 of plug connector 56. The details of socket connector 48** now will be described.

More particularly, referring to FIGS. 9–13, socket connector 48 includes an elongated dielectric housing, generally designated 140 (FIGS. 9–11), and a stamped and formed metal grounding bar, generally designated 143 (FIG. 13) mounted on housing 140 and extending lengthwise thereof. As will be described in detail hereinafter, the grounding bar is designed for conductive connection to grounding circuit traces on daughter board 24 and for conductive engagement with grounding contacts 72 of a plurality of shielded plug connectors 56 assembled into the socket connector.

Elongated housing 140 (FIGS. 9–11) of socket connector 48 includes upper and lower pairs of the separator ribs 52 (described above in relation to FIG. 2) whereby the separator ribs define distinct receptacles for receiving the plug connectors. In the embodiment illustrated in the drawings, the elongated housing is divided by four pairs of separator ribs 52 to define four receptacles for four plug connectors. The housing has four grooves 142 on the outside thereof and spaced along one elongated side of the housing, and a similar array of four grooves 144 on the outside of the housing and spaced along the opposite side thereof. Grooves 142 terminate in latching ledges 142*a*, and grooves 144 also terminate in similar latching ledges not visible in FIG. 9. When plug connectors 56 are inserted into socket connector 48, latch arms 94 of hood halves 66 move into grooves 142 until hook portions 94*a* of the latch arms snap behind latching ledges 142*a*. Similarly, latch arms 106 of hood parts 68 of the plug connectors move into grooves 144 until the hook portions 106*a* of the latch arms snap behind the latching ledges of grooves 144.

Polarization means are provided between socket connector 48 and each plug connector 56 to ensure proper orientation of the plug connectors in the receptacles of the socket connector defined by separator ribs 52. More particularly, it can be seen in FIGS. 9 and 11 that grooves 142 on the outside of one side of socket connector housing 140 are wider than grooves 144 on the opposite side of the housing. Now, turning back to FIG. 4, it can be seen that latch arm 94 of hood part 66 is wider than latch arm 106 of hood part 68. Therefore, the plug connectors must be oriented so as to be mated in the socket connector in a given orientation whereby the wider latch arms 94 will enter the wider grooves 142 and the narrower latch arms 106 will enter the narrower grooves 144.

Figures 9, 13:
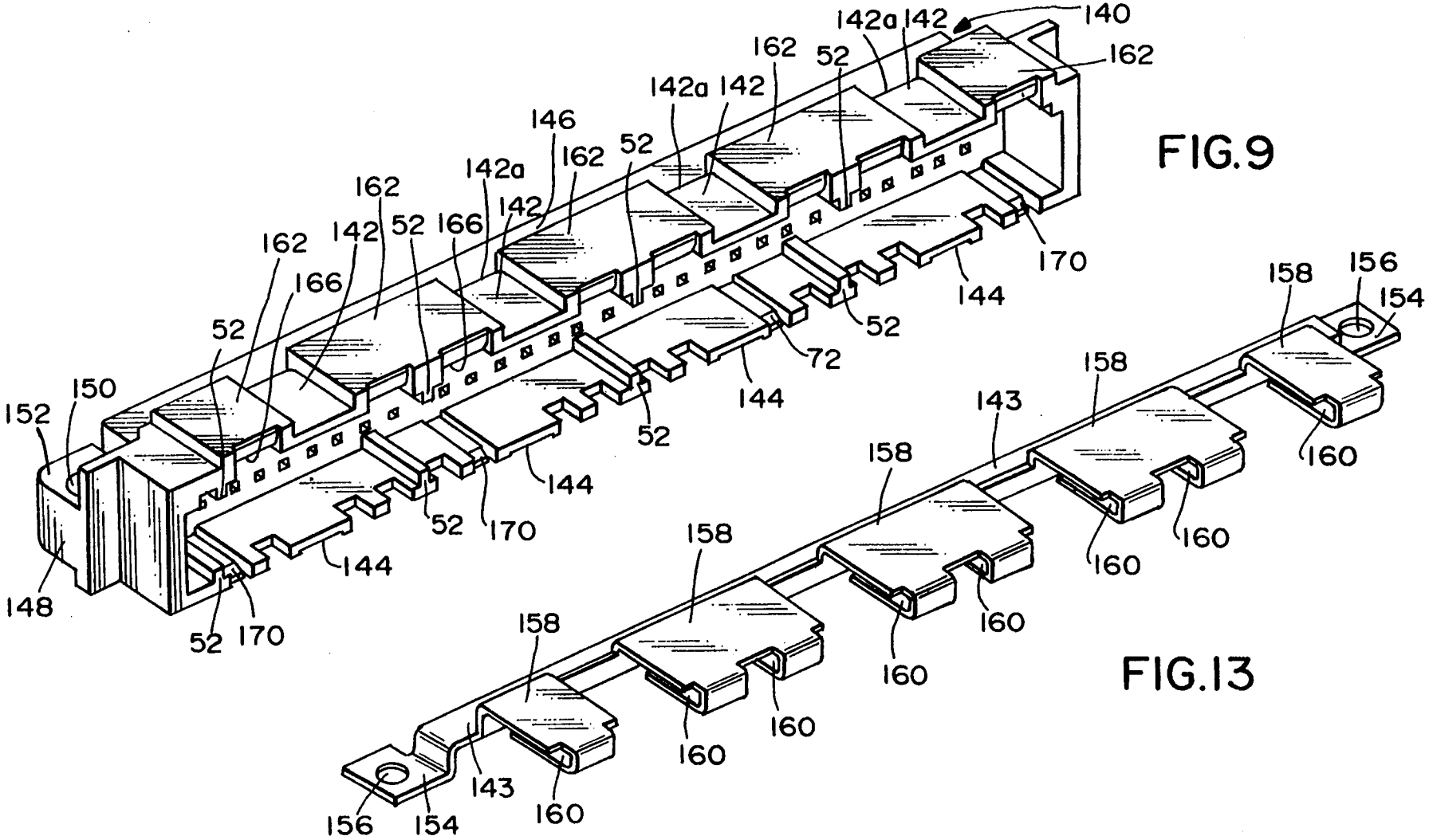
FIG. 9 is a perspective view of the elongated dielectric housing of the multi-receptacle socket connector.
FIG. 13 is a perspective view of the grounding bar of the socket connector.
Figure 10:
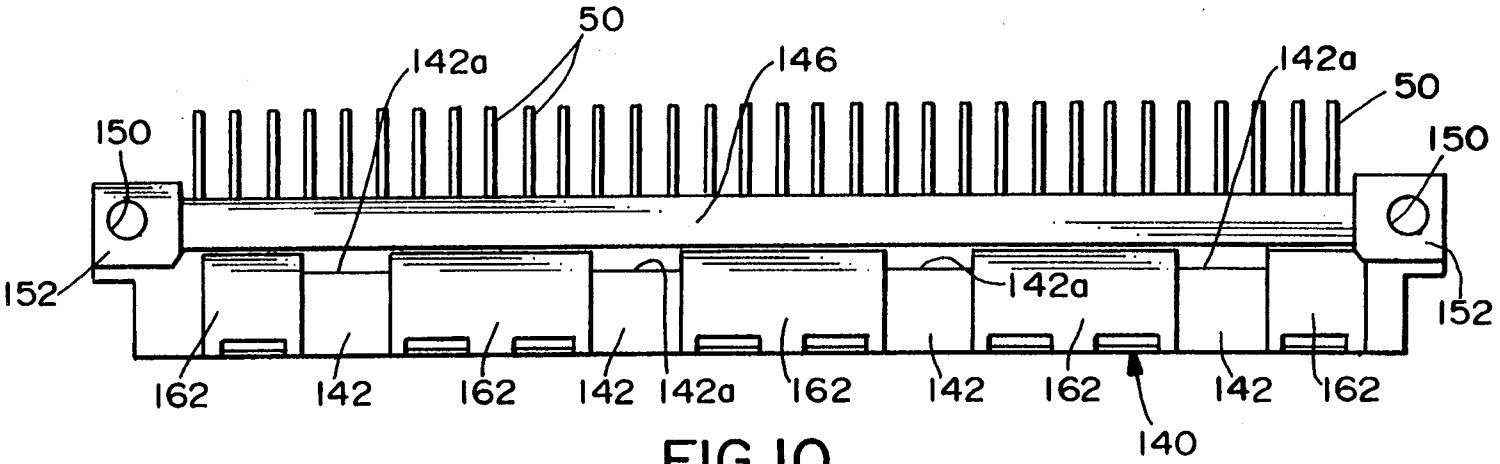
FIG. 10 is a top plan view of the socket connector housing.
Figure 11:
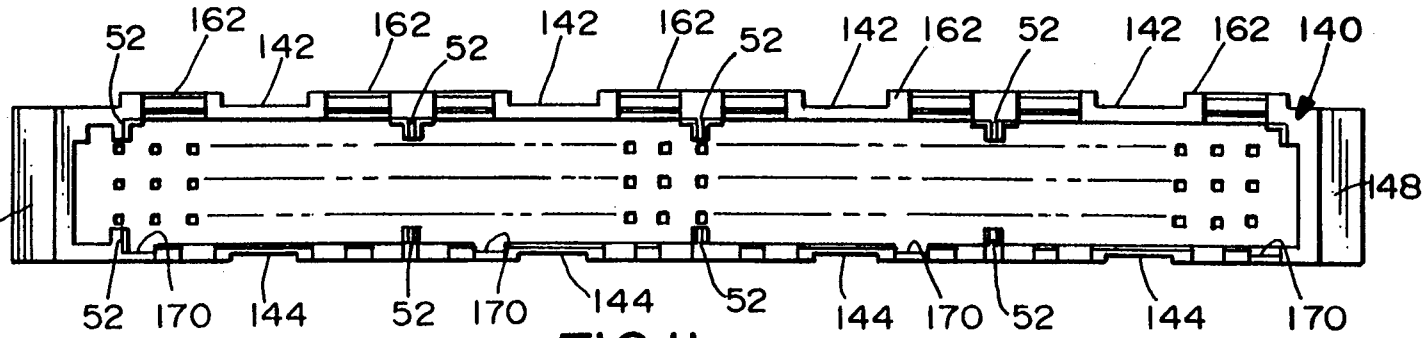
FIG. 11 is a front elevational view of the socket connector housing.
Figure 12:
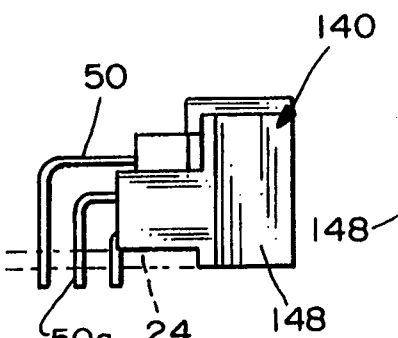
FIG. 12 is an end elevational view of the socket connector housing.

Referring to FIG. 13 in conjunction with FIG. 9, it can be seen that housing 140 has a rear ledge 146 on which grounding bar 143 is positioned in shielded applications. The housing has a pair of mounting bosses 148 at opposite ends thereof, the mounting bosses having through holes 150. The mounting bosses have surfaces 152 offset from ledge 146. Correspondingly, inwardly offset flanges 154 (FIG. 13) are formed at opposite ends of grounding bar 143, the flanges having mounting holes 156 therethrough. Therefore, when grounding bar 143 rests on ledge 146 of housing 140, flanges 154 of the grounding bar rest on surfaces 152 of mounting bosses 148 of the housing, with holes 152 in the housing and holes 156 in the grounding bar aligned. Therefore, the grounding bar is adapted for receiving a conductive interconnecting means, such as a rivet described hereinafter, to conductively connect the grounding bar, through housing 140, to ground circuits on daughter board 24.

Grounding bar 143 also is provided with means for respectively engaging forward portions 124 (FIGS. 5 and 6) of grounding contacts 72 of the plug connectors. More particularly, FIG. 13 shows the grounding bar with a plurality of forwardly projecting cantilevered beams 158 having reverse bent portions or distal ends 160. When grounding bar 143 rests on top of ledge 146 (FIG. 9) of housing 140, cantilevered beams 158 rest on top of plateau areas 162 of housing 140, and reverse bent portions 160 of the cantilevered beams are bent about a mating edge 164 of housing 140 and into grooves 166 within the receptacle area of the housing. In other words, reverse bent portions 160 of cantilevered beams 158 are exposed at or within the receptacles of the housing defined by separator ribs 52. It can be seen that there are two longitudinally spaced grooves 166 for receiving two reverse bent portions 160 of cantilevered beams 158 for each receptacle between separator ribs 152. Now, again referring back to FIGS. 5 and 6, it can be seen that forward portion 124 of each grounding contact 72 includes two spring tongues 124*a*. These spring tongues engage reverse bent portions 160 of cantilevered beams 158 of grounding bar 143 when the plug connectors are inserted into socket connector 48.

Figure 16:
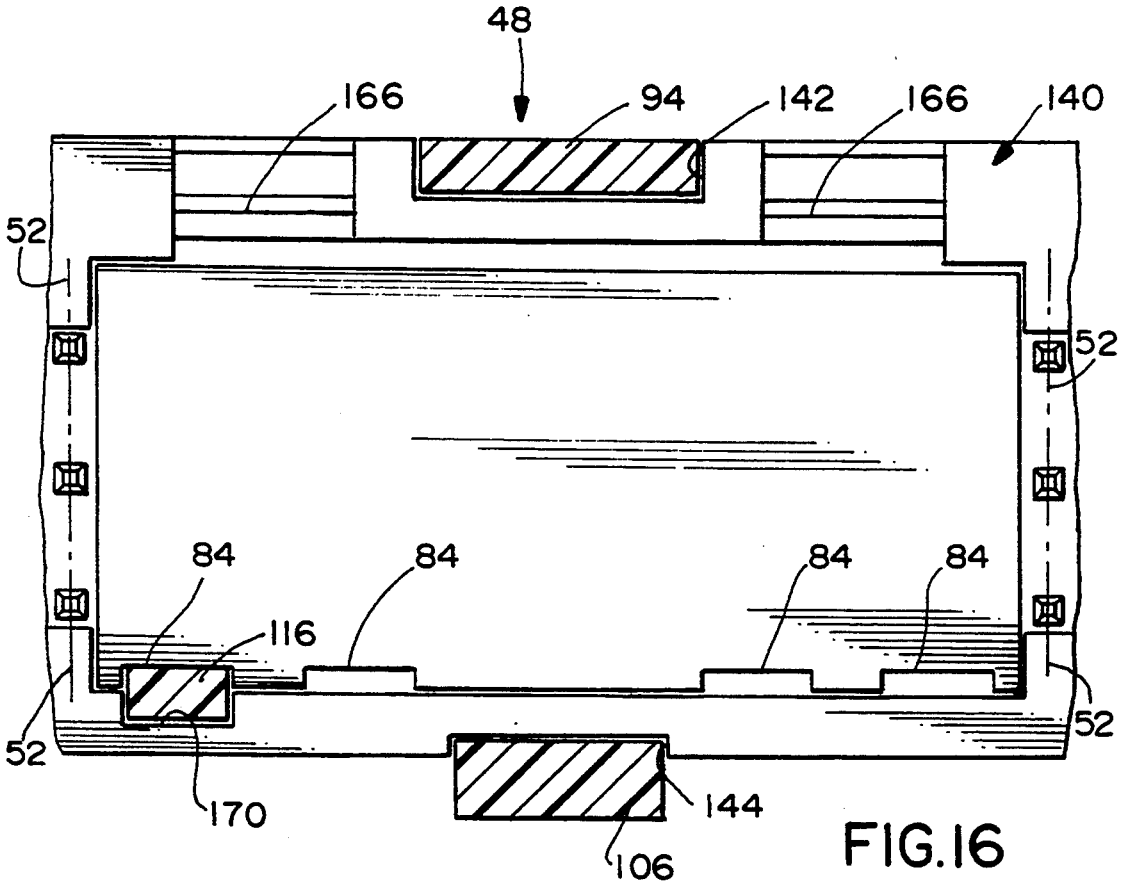
FIG. 16 is a fragmented longitudinal section through the polarizing latch arms and one of the keys of a plug connector at appropriate locations relative to the socket connector, with the grounding contact of the plug connector and the grounding bar of the socket connector removed to facilitate the illustration.
Figure 17:
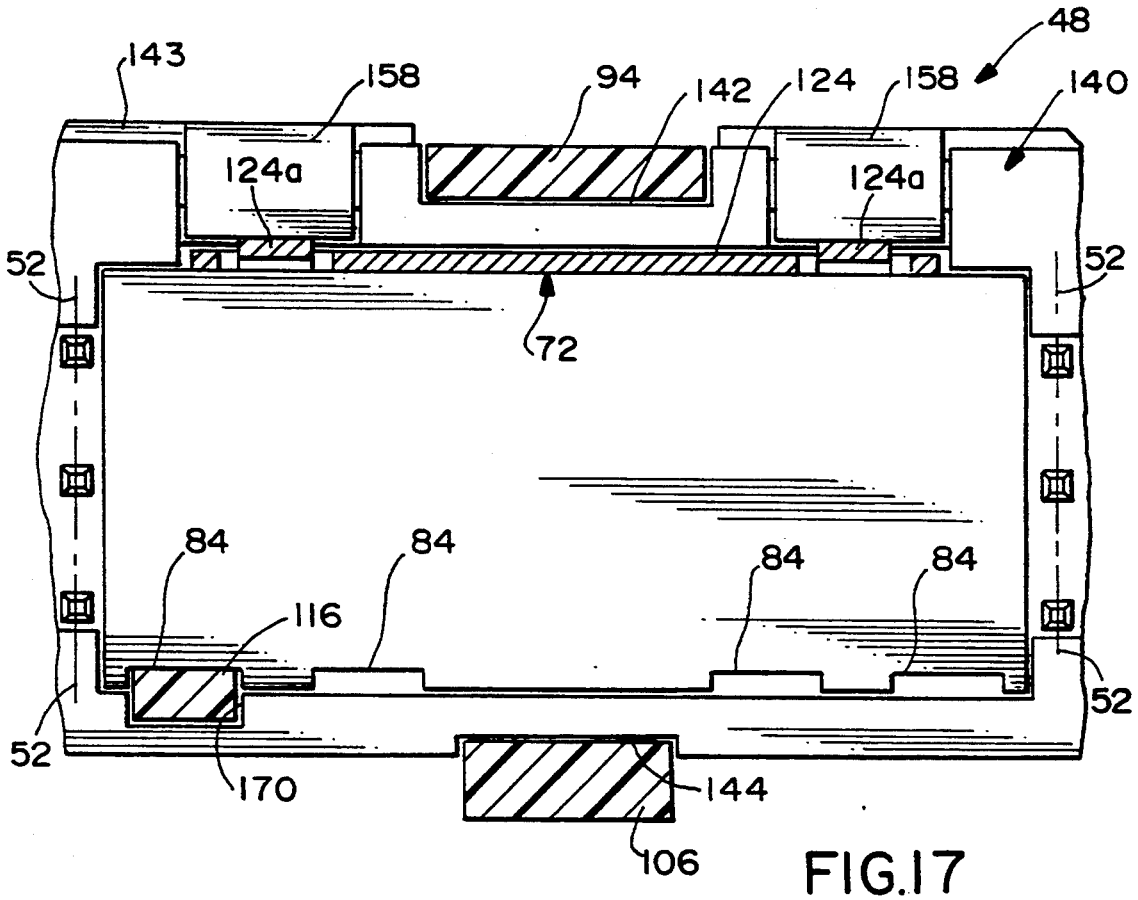
FIG. 17 is a longitudinal section similar to that of FIG. 16, with the grounding contact of the shielded plug connector and the grounding bar of the socket connector fully illustrated.

The polarization means between the plug connectors and the socket connector, as well as the grounding of the grounding contacts of the plug connectors with the grounding bar of the socket connector, can easily be understood with reference to FIGS. 16 and 17.

More particularly, it can be seen in FIGS. 16 and 17 that latch arms 94 of hood part 66 of any given plug connector, along with a respective groove 142 in socket connector housing 40, is wider than latch arm 106 of housing part 68 of the plug connector, along with a groove 144 of the socket connector housing.

FIG. 16 is a depiction of the housing, with grounding bar 143 removed to illustrate grooves 166 of the housing for receiving reverse bent portions 160 (FIG. 13) of cantilevered beams 158 of the grounding bar. FIG. 17 is a view similar to that of FIG. 16, but illustrating grounding bar 143 with cantilevered beams 158 in position for engaging spring tongues 124*a* of forward portion 124 of grounding contact 72 of one of the plug connectors.

Another feature of the invention is the provision of keying means between socket connector 48, at each receptacle thereof, and each plug connector 56, whereby each plug connector can be received by only a given one of the receptacles defined by separator ribs 52 of housing 140 of the socket connector.

More particularly, as stated above in describing FIG. 4, hood part 68 is provided with four forwardly projecting keys 116. The keys are selectively frangible or capable of being broken away from the hood part to leave one or more keys remaining for keying purposes. As stated above, the keys partially rest in recesses 84 of plug connector housing 70. This protects the keys from accidental breaking. Now, referring to FIG. 9, and shown in FIGS. 16 and 17, it can be seen that a keyway 170 is provided at each receptacle defined between separator ribs 52. Each keyway 170 at each receptacle is at a different location, i.e. at a location corresponding to only one of the four keys 116 of the plug connectors. In order to key plug connectors 56 to socket connector 48, keying projections 116 (FIG. 4) are selectively broken away in order to leave one key matching the location of a keyway 170 at only one of the receptacles of the socket connector, in a desired program or electronic scheme for interconnecting the plurality of plug connectors with a particular circuitry on daughter board 24.

Figure 14:
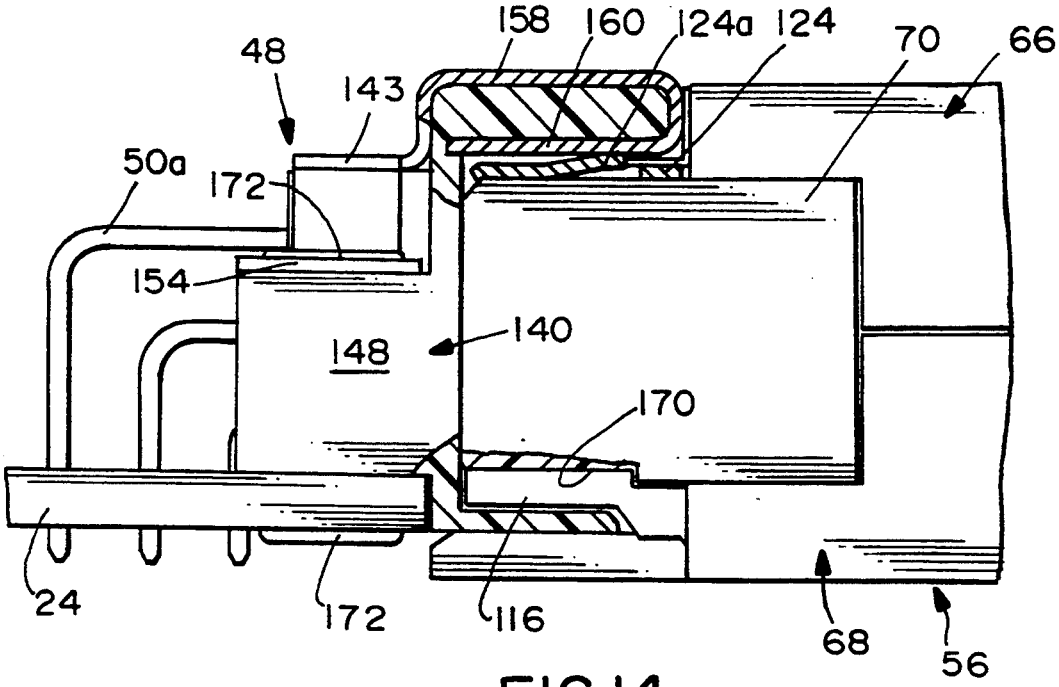
FIG. 14 is a vertical section, on an enlarged scale, through the socket connector and a mated one of the shielded plug connectors, at a location longitudinal of the housing to show the interengagement of the grounding contact of the plug connector with the grounding bar of the socket connector.

FIG. 14 shows how one of the keying projections 116 projects into one of the keyways 170. In addition, FIG. 14 shows how one of the cantilevered beams 158 of grounding bar 143 has a reverse bent portion 160 for engaging one of the spring tongues 124*a* of forward portion 124 of grounding contact 72 of one of the plug connectors 56. Lastly, FIG. 14 shows a conductive rivet 172 projecting through flange 154 of grounding bar 152, through mounting boss 148 of socket connector housing 140, and through daughter board 24 for conductively grounding the grounding bar to a ground trace on the daughter board.

Figure 15:
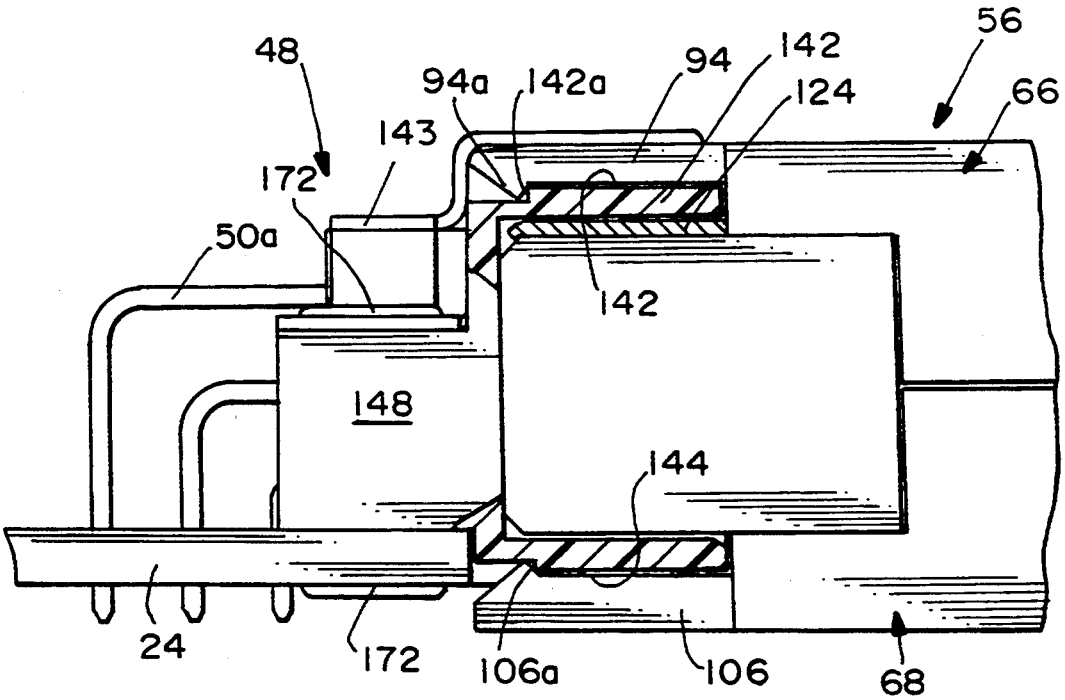
FIG. 15 is a vertical section similar to that of FIG. 14, but at a location to show the interconnection of the polarizing latch arms of the plug connector with the socket connector.

Lastly, FIG. 15 shows how hook portions 94*a* of latch arms 94 and hook portions 106*a* of latch arms 106 latch the plug connectors into mating condition within the socket connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A shielded plug and socket electrical connector system for interconnecting a plurality of shielded electrical cables (46) with a printed circuit board (24), comprising:

a plurality of plug connectors (56) each including a dielectric housing (70) adapted for mounting a plurality of terminals terminated to conductors (78) of a shielded cable (80), a shielding hood (66,68) configured for substantially enclosing the housing, and a grounding contact (72) fitted within the shielding hood and including a first plug portion (122) adapted for conductively engaging a shield (82) of the cable and a second plug portion (124) exposed exteriorly of the hood;

a socket connector (48) for mounting to the printed circuit board (24) and including an elongated dielectric housing (140) defining a plurality of receptacles (52) each for receiving a corresponding one of the plurality of plug connectors (56), and a grounding bar (142) mounted on the housing and extending lengthwise thereof, including a first socket portion (154) adapted to electrically connect to a grounding circuit trace on the printed circuit board (24) and a plurality of second socket portions (160) each located adjacent a receptacle (52) and adapted to engage the second plug portion (124) of the grounding contact (72) of each of the corresponding plurality of plug connectors when received within the receptacle; and polarization means (94,106, 142,144) between the socket connector (48) and each plug connector (56) including a pair of latches (94,106) on one of the socket connector (48) and each plug connector (56) and a complementary pair of latch grooves (142,144) on the other of the socket connector and each plug connector, wherein one of the pair of latches (94) and its respective latch groove (142) is of a different size than the other (106) of the pair of latches and its respective latch groove (144) thereby ensuring proper orientation of the each plug connector with respect to the corresponding receptacle.

2. The plug and socket electrical connector system of claim 1, wherein the shielding hood is a two-part hood, and wherein the grounding contact is fitted within a first part (66) of the two-part hood, and including complementary interengaging means (126) between the grounding contact (72) of each plug connector (56) and a second part (68) of the two-part shielding hood thereof for interconnecting the two parts of the hood about the dielectric housing (70).

3. The plug and socket electrical connector system of claim 2 wherein said complementary interengaging means include at least one interengaging arm (126) of the grounding contact (72) projecting from the first part (66) of the two-part shielding hood into locking engagement with the second part (68) of the two-part hood.

4. The plug and socket electrical connector system of claim 3 wherein said interengaging arm (126) includes locking means (126*b*) for locking the grounding contact within the first part (66) of the two-part shielding hood.

5. The plug and socket electrical connector system of claim 2 wherein said grounding contact (72) includes a body portion (120) within the first part (66) of the two-part shielding hood, said first plug portion (122) of the grounding contact being located at a rear end of the body portion, said exposed second plug portion (124) of the grounding contact being located at a forward end of the body portion, and said complementary interengaging means (126) being located intermediate the ends of the body portion.

6. The plug and socket electrical connector system of claim 5 wherein said complementary interengaging means include at least one interengaging arm (126) of the grounding contact projecting from the first part (66) of the two-part shielding hood into locking engagement with the second part (68) of the two-part hood.

7. The plug and socket electrical connector system of claim 1 wherein the receptacles of the dielectric housing (140) of the socket connector (48) are defined at least in part by a mating edge (164) of the housing, and said plurality of second socket portions (160) of the grounding bar (142) comprise cantilevered beams (158) located along the grounding bar and reversely bent into the receptacles for respectively engaging the second plug portions (124) of the grounding contacts (72) of the plug connectors (56).

8. The plug and socket electrical connector system of claim 1, including keying means (170,116) between the socket connector (48), at each receptacle thereof, and each plug connector (56), whereby each plug connector can be received by only a given one of the receptacles.

9. The plug and socket electrical connector system of claim 8, wherein said keying means comprise at least one keyway (170) in the housing of the socket connector (48) at each receptacle thereof and at a location different from that of the other receptacles, and a plurality of frangible keys (116) on each plug connector (56) at locations corresponding to all of the different locations of keyways at the receptacles in the socket connector housing, whereby the keys can be broken away to leave a key for each plug connector at a location corresponding to the location of a keyway at a desired receptacle in which the respective connector is desired to be inserted.

10. A plug and socket electrical connector system for interconnecting a plurality of electrical cables (46) with a printed circuit board (24), including:

a) a plurality of plug connectors (56) each having a dielectric housing (70) adapted for mounting a plurality of terminals terminated to conductors of a cable (80), and a hood (66,68) configured for substantially enclosing the housing; and b) a socket connector (48) for mounting to the printed circuit board (24) and having an elongated dielectric housing (140) defining a plurality of receptacles (52) for receiving the plurality of said plug connectors (56);

the improvement comprising:

polarization means (94,106, 142,144) between the socket connector (48) and each plug connector (56) comprising a pair of latches (94,106) on one of the socket connector (48) and each plug connector (56) and a complementary pair of latch grooves (142,144) on the other of the socket connector and each plug connector, wherein one latch (94) of each pair of latches and its respective latch groove (142) is of a different size than the other latch (106) of each pair of latches and its respective latch groove (144) to ensure proper orientation of each plug connector with respect to its corresponding receptacle, and keying means (170, 116) between the socket connector (48) and each plug connector (56), comprising at least one keyway (170) in the housing of the socket connector (48) at each receptacle thereof and at a location different from that of the other receptacles, and a key (116) on each plug connector (56) at a location corresponding to the location of the at least one keyway in each receptacle of the socket connector housing, whereby each plug connector can be received by only a given one of the receptacles.

11. The plug and socket electrical connector system as set forth in claim 10 wherein each plug connector (56) includes a plurality of frangible keys (116) and wherein each of the plurality of keys can be broken away to leave a single key for each plug connector at a unique location corresponding to the location of the keyway in the corresponding receptacle.

* * * * *